United States Patent [19]

Doty

[11] 4,171,085

[45] Oct. 16, 1979

[54] TEAR TAB DISPOSABLE CUP OR CONTAINER STRUCTURE

[75] Inventor: William T. Doty, Towson, Md.

[73] Assignee: Maryland Cup Corporation, Owings Mills, Md.

[21] Appl. No.: 845,793

[22] Filed: Oct. 26, 1977

[51] Int. Cl.[2] ..... B65D 3/06; B65D 3/28

[52] U.S. Cl. ..... 229/1.5 B; 40/306; 206/459

[58] Field of Search ..... 229/1.5 B, 1.5 C; 40/306; 206/234, 459

[56] References Cited

U.S. PATENT DOCUMENTS

| | | | |
|---|---|---|---|
| 2,093,985 | 9/1937 | Starsburg | 40/306 |
| 2,134,971 | 11/1938 | Guyer | 229/8 |
| 2,745,586 | 5/1956 | Thoma | 229/1.5 C |
| 3,827,620 | 8/1974 | Ludder | 206/459 |
| 3,850,361 | 11/1974 | Day | 40/306 |

*Primary Examiner*—George E. Lowrance

*Attorney, Agent, or Firm*—Birch, Stewart, Kolasch and Birch

[57] ABSTRACT

A paper or plastic cup or container is provided having a pull-tab extending from the side seam which can be torn off by the consumer to be used as a coupon, proof-of-purchase or to reveal some form of concealed marking which might entitle the consumer to a premium, gift or other consideration. The pull-tab is notched and/or perforated in such a manner as to direct the tear parallel to the glue line of the sidewall seam and prevent it from crossing said glue line, thus maintaining the integrity of the container and preventing leakage or spill of the contents.

2 Claims, 3 Drawing Figures

TEAR TAB DISPOSABLE CUP OR CONTAINER STRUCTURE

FIELD OF THE INVENTION

This invention relates to paper or plastic cups or containers for the dispensing of edible products and more particularly to a paper or plastic cup or container with a pull-tab thereon which when torn off indicates to the public that the container has previously been used.

BACKGROUND OF THE INVENTION

Concessionaires and others in the food service business have traditionally used cup and container count as a means of controlling inventories and cash return. As an example, if a counter clerk uses 100 cups, he should turn in an amount of cash equal to the selling price of 100 servings of the product to be dispensed in such cups. Problems arise when a clerk reuses cups left on the premises or smuggles in extra cups from outside.

By using premium promotions which involve consumers tearing tabs from the sidewall of such cups or containers, such as taught by the present invention, the cups will become mutilated and impractical for reuse. Furthermore, the unique structure of such cups and containers would make them speciality items which would not be easily available to the clerks to obtain outside of the normal source of supplies of the food service business in which these cups are being utilized. The mutilatable type cup or container is more affective to prevent reuse than special imprint containers since there is nothing to prevent the reuse of specially imprinted containers and often, such reuse occurs.

Thus, a mutilated cup or container cannot be reused and eliminates the dishonest and unsanitary practices which have been found to occur in the trade.

It is also desirable from a purely promotional standpoint to promote sales of beverages and other foods such as popcorn, french fries and the like by offering premiums. In the prior art, proof-of-purchase coupons which are redeemable have been printed on cup sidewalls and tearing out these coupons from used cups is both messy and unsanitary.

Another approach to such cups or containers in the prior art is illustrated in U.S. Pat. No. 3,827,620 to Rodney E. Ludder issued Aug. 6, 1974, for Non-Reusable Nestable Cup or Container. In this particular form of cup or container, the glued area along the side seamline of the container has a portion thereof in which the area beneath a defined tear-off tab is unglued and the consumer is encouraged to place a fingernail beneath the indicated unglued area to tear off a portion of the same. Because of the fact that the tear-off tab goes across an already thinly glued area of the side seam and into the sidewall paper beyond it, there is a severe weakening of the sidewall paper beyond the glued side seam which tends to destroy the liquid-tight integrity of the container.

It is, therefore, an object of the present invention to provide a premium tab for disposable cups and containers of paper or plastic which is dry and clean and which offers a superior and more pleasing method of collecting and redeeming such coupons.

Another object of the present invention is to provide a readily mutilatable paper or plastic cup or container by the provision of a premium tab along the sidewall thereof such that mutilation of the container will substantially preclude its reuse by employees of food service operations.

Yet another object of the present invention is to provide a new and novel paper or plastic cup or container which includes a removable pull-tab for the purpose of mutilating the exterior of the cup or container without damaging the liquid-tight integrity thereof.

SUMMARY OF THE INVENTION

A paper or plastic cup or container is provided with a pull-tab integral with the edge of the sidewall blank from which the container sidewall is formed but which tab portion extends outward beyond the normally glued area of the sidewall such that removal of the pull-tab leaves a full-width glued area in the side seam and does not destroy the liquid-tight integrity of the container. The lowermost portion of the tab outboard of the normal glue area of the sidewall seam is included in the bottom curl of a typical frusto-conical container embodying the present invention such that the lowermost tear portion is defined by the lowermost edge of the sidewall portion outside the glue line.

A smooth tear starting notch is positioned at the uppermost portion of the pull-tab immediately adjacent the normal glued area in the sidewall seam to facilitate the initial tearing of the tab from the container.

DETAILED DESCRIPTION OF THE DRAWINGS

Figure 1:
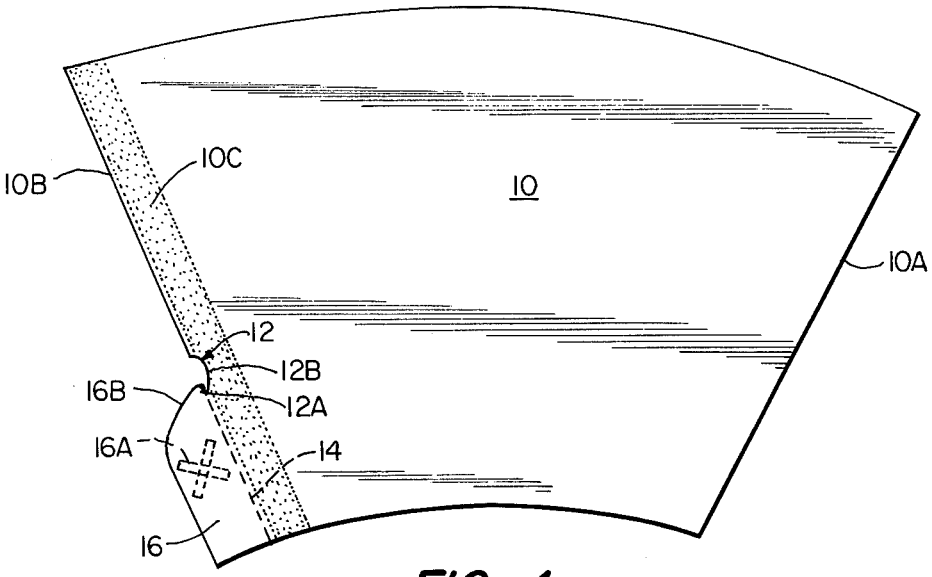
FIG. 1 is a front plan view of a sidewall blank of a container of the present invention illustrating the pull-tab configuration and the relative position of that pull-tab with the normal glue area on the sidewall blank.

Referring in detail to the drawings and with particular reference to FIG. 1, the sidewall blank 10 of the present invention is shown as being arcuate in configuration such as is conventional for the fabrication of frusto-conical sidewalls and is fabricated of suitable paper or plastic material.

The right-hand edge 10A of the sidewall blank 10 is a straight line configuration as shown and is adapted to be curled beneath the left-hand edge 10B to the extent that the glue area illustrated as a shaded rectangular area 10C will completely overlie and engage one face of the sidewall blank 10 immediately adjacent and coterminate with the right-hand edge 10A thereof.

The left-hand edge portion 10B is a straight line portion from the uppermost edge thereof down to a point substantially below the central portion of the blank 10 at which point an arcuate notch 12 having a sharp apex 12A and a smooth arcuate inner wall portion 12B is formed to define the direction of a seam line 14 outboard of the glue area 10C and defining the innermost edge of a pull-tab 16 which extends completely outboard of the side edge 10B adjacent the glue area 10C at the lowermost extremity of the left edge 10B of the sidewall 10 from a point just above the apex 12A of the notch 12 down to the lowermost extremity of the sidewall blank 10. Indicia or premium information 16A is provided on the underneath surface of the pull-tab 16 on the same side of the sidewall blank 10 as the glue area 10C.

Figure 2:
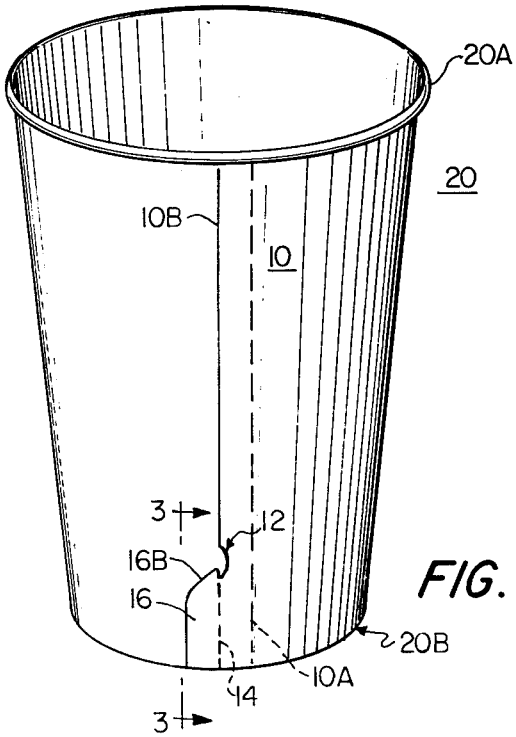
FIG. 2 is a perspective of an assembled container of the present invention.
Figure 3:
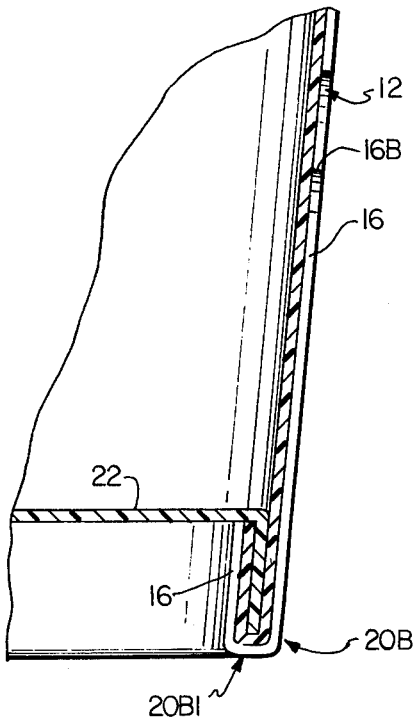
FIG. 3 is a cross-section in enlarged detail showing the bottom curl of one side of the assembled container of the present invention.

As shown in FIGS. 2 and 3, when the sidewall is fully assembled into a cup or container 20 having a top curl 20A and a bottom curl portion or crimp 20B the pull-tab 16 is shown as overlying the sidewall blank 10 substantially inboard of the previously outboard right-hand edge 10A of the sidewall blank 10. Also, the notch 12 is shown as clearly defining a place on the sidewall 10 of the finished container 20 where the finger of a consumer can be inserted to grip the upper tab portion 16B of the pull-tab 16 adjacent the notch 12 for the purpose of removing the pull-tab substantially along the indicated tear line 14 down to the apex 20B1 of the bottom curl 20B at which point the return or reentrant shape of the pull-tab 16 will tend to cause it to tear off the container 20 at the apex 20B1 of the bottom curl 20B. However, since there is no glue beneath the pull-tab 16 and since it is outboard of the normally glued area 10C of the side seam formation 10A-10B-10C of the container 20, the pull-tab 16 can be torn down beneath the apex 20B1 of the bottom curl 20B and back upwards towards the bottom portion 22 of the container 20 without damaging the liquid-tight integrity of the container 20. The cross-section of the bottom curl structure in FIG. 3 further illustrates this point.

Thus, it is clear that the placing of the indicia or premium information 16A beneath the pull-tab 16 on the container 20 of the present invention provides an incentive to the customer to mutilate the cup or container 20 by removing the pull-tab 16 to determine whether or not a prize winning premium has been uncovered and at the same time to be able to continue to use the cup or container without the danger of spilling the contents because the particular pull-tab structure 16 of the present invention enhances the liquid-tight integrity of the container while still permitting it to be mutilated during use.

It should be understood that the tear tab disposable cup or container structure of the present invention may be modified as would occur to one of ordinary skill in the art without departing from the spirit and scope of the present invention.

It is claimed:

1. In a container having a tubular sidewall with a substantially vertical lapped side seam extending from an open top curl configuuation to a closed bottom curl configuration, said side seam including a coextensive bonded area within the lapped confines of said side seam providing liquid-tight integrity to said container, the improvement comprising:

a sidewall blank having first and second side edges for forming respective exterior and interior layers of said lapped side seam; and a tearable tab formed integral with said blank outboard of said first edge beyond the said bonded area of said side seam;

said tab being tearable along the outermost edge of said bonded area to preserve the liquid-tight integrity of said side seam while simultaneously defacing said container sufficiently to indicate prior use thereof; and said tab further including a tear starting notch defined therein adjacent the outboard edge of said bonded area and directed to induce tearing substantially parallel to said outboard edge in response to a tearing stress on said tab, said tab extending from a point above said closed bottom curl around the apex thereof and being contiguous therewith.

2. The invention defined in claim 1, wherein said tab conceals premium indicia in its untorn state and reveals said indicia upon removal from said container.

* * * * *